United States Patent [19]

Kunkel

[11] 4,206,723

[45] Jun. 10, 1980

[54] DOUBLE-FIRED HEATING BOILER

[75] Inventor: Wolfgang Kunkel, Triesen, Liechtenstein

[73] Assignee: Interliz Anstalt, Neugut, Liechtenstein

[21] Appl. No.: 970,906

[22] Filed: Dec. 19, 1978

Related U.S. Application Data

[63] Continuation of Ser. No. 811,394, Jun. 29, 1977, abandoned.

[30] Foreign Application Priority Data

Jul. 8, 1976 [DE] Fed. Rep. of Germany ..... 2630728

[51] Int. Cl.[2] ..... F22B 31/04

[52] U.S. Cl. ..... 122/22; 122/2; 122/149

[58] Field of Search ..... 122/2, 22, 149

[56] References Cited

U.S. PATENT DOCUMENTS

| | | | |
|---|---|---|---|
| 1,691,462 | 11/1928 | Borge | 122/2 |
| 2,891,519 | 6/1959 | Ross | 122/2 |
| 3,223,074 | 12/1965 | Tanner et al. | 122/2 |
| 3,251,345 | 5/1966 | Brody et al. | 122/2 |
| 3,329,131 | 7/1967 | Wright | 122/149 |
| 3,736,907 | 6/1973 | Agrest | 122/2 |
| 4,029,057 | 6/1977 | Frechette | 122/149 |

FOREIGN PATENT DOCUMENTS

| | | | |
|---|---|---|---|
| 1238643 | 4/1967 | Fed. Rep. of Germany | 122/2 |
| 1239050 | 4/1967 | Fed. Rep. of Germany | 122/2 |
| 2540709 | 3/1977 | Fed. Rep. of Germany | 122/2 |
| 966236 | 8/1964 | United Kingdom | 122/2 |

*Primary Examiner*—Henry C. Yuen
*Attorney, Agent, or Firm*—Jordan and Hamburg

[57] ABSTRACT

A double-fired heating boiler includes first and second combustion chambers positioned within a common boiler water chamber and adapted to be fired respectively by gas or oil and by solid fuel. A collector for the combustion gases produced by the burning of the fluid and solid fuel is provided. Separate exhaust conduit systems having ancillary heat exchange surfaces are connected to the respective combustion chambers and to the collector.

4 Claims, 3 Drawing Figures

DOUBLE-FIRED HEATING BOILER

This is a continuation of application Ser. No. 811,394, filed June 29, 1977, now abandoned.

BACKGROUND OF THE INVENTION

The present invention relates to a heating boiler which can be fired by oil, gas or by solid fuel and which is provided with separate combustion chambers for the oil or gas burner and for the solid fuel. The combustion chambers are located in a common boiler water chamber and are connected with conduits for the combustion gases extending through the boiler water chamber and forming ancillary heating surfaces. The combustion gases are thereafter collected and drawn off by means of the usual flue.

In oil or gas-fired heating installations, especially with oil-firing, it is frequently desirable or necessary to be able also to burn solid fuels, especially wood, in the heating boiler of the installation. The setting up of an additional separate solid fuel-fired boiler, the provision of water connections coupling the boilers and of combustion as exhaust conduits connected with a common collector, is very expensive. Such interconnection of the boilers also requires the use of complex valving and control elements in the water circulating system and for the actuation of shut-off flaps in the exhaust system for the combustion gases to accommodate changeover from firing by one fuel to another. Therefore, double-fired boilers have been produced heretofore which contain separate combustion chambers for oil or gas-firing and for solid fuels, such chambers being located within a common boiler water jacket or boiler water space. These conventional double-fired boilers, however, always have common ancillary heating surfaces, for conveying the combustion gases from the burner firing combustion chamber and from the solid fuel combustion chamber. For example, it is known without having to increase the size of the usual heating boiler, to arrange a smaller oil or gas burner firing combustion chamber within a larger solid fuel combustion chamber and to exhaust the combustion gases by way of a connecting passage with the solid fuel combustion chamber. The combustion gases from the burner firing thus flow through the same exhaust conduits and ancillary heating surfaces in the heating boiler as do the combustion gases produced by the burning of the solid fuel in the solid fuel combustion chamber. These common ancillary heating surfaces of the known double-fired boilers have the disadvantage that ashes and other combustion residues such as always occur, for example, when wood is burned, accumulate on the ancillary heating surfaces used also for the combustion gases produced by the burner firing. This has a very disadvantageous and unfavorable effect upon the efficiency of the oil or gas-firing mode, which represents the normal type of firing in double-fired boilers and which requires the cleanest and most deposit-free ancillary heating surfaces for the achievement of high efficiency and economical fuel consumption. Deposits of ashes and other combustion residues as occurs in the burning of wood or other solid fuels can block the common combustion gas exhaust conduits and thus have extremely disadvantageous effects upon the pressure and flow conditions necessary for satisfactory burner operation. The common exhaust conduits of the known double-fired boiler would, therefore, have to be formed with increased unobstructed internal dimensions in order that after the burning of wood or other solid fuels it is possible to continue operation with burner firing without the need to first clean such conduits.

The invention thus deals with the problems of two-chamber heating boilers of the character described which avoids the disadvantages and drawbacks of presently known double-fired boilers.

The heating boiler according to the invention employs separate combustion gas exhaust systems connected to the two combustion chambers which pass completely separately from one another through the boiler water or compartment and terminate in a common combustion gas collector and flue for the heating boiler. Thus, both the combustion chambers or firing chambers and the ancillary heating surfaces for the oil or gas-firing and for the solid fuels are completely separate from one another upstream of the common collector and flue for the heating boiler. Fouling of the ancillary heating surfaces for the oil or gas-firing by the ash or other combustion residues occurring during the solid fuel firing is thus completely avoided, thereby insuring consistently high efficiencies and economy for the oil or gas-firing system. Moreover, the exhuast conduits and the ancillary heating surfaces formed by them may be constructed with the configuration, length and cross-sectional dimensions which are most expedient and favorable for the oil or gas-burner firing on the one hand and for the solid fuel firing on the other. The exhaust conduits for the solid fuel firing, for example, can be dimensioned to provide relatively large unobstructed internal passages in order to guarantee the longest possible maintenance-free firing time with solid fuels while the completely separate exhaust conduits for the oil and gas-burner firing can, in the manner favorable for this type of firing, comprise a plurality of finned pipes. Moreover, the separate combustion chambers and the completely separate exhaust systems can be arranged so that both the oil and gas-burner firing system and the solid fuel firing system can be fitted with only vertical conduits so that the burner firing system is also suitable for firing with atmospheric gas burners. The complete separation of the exhaust systems also offers a better possibility of forming the two combustion chambers independently of one another as is most favorable for the type of firing in each case. The combustion chamber for the burner firing, for example, can be of very large and deep dimensions to accommodate a particular specific flame reversal pattern and may be designed with dimensions for oil-firing to provide for optimum radiation transmission in order to reduce the production of unburnt oil derivatives which result in unpleasant odors, due to under-cooled combustion chamber zones. Irrespective of the formation of the combustion chamber and of the exhaust conduit system for the burner firing, the combustion chamber for the solid fuel firing can be of extraordinarily large dimensions in order to provide a large space for bulky solids such as wood. This latter combustion chamber and the connection of its exhaust conduits can be formed so that the combustion chamber is especially well adapted for the under-burning of long-flamed fuels such as wood, peat, cheap brown coal and the like, which are most commonly used for burning in the heating boiler.

It is one object of the invention to provide a heating boiler in which separate combustion chambers for oil or gas or for solid fuel located within a common boiler water compartment can be converted from solid fuel-firing to firing by oil or gas without the need for cleaning of the combustion gas exhaust conduits.

It is another object of the invention to provide a double-fired heating boiler which can be operated selectively in either its oil or gas-fired mode or by the burning of solid fuel without the need to increase the size of the common combustion gas exhaust conduits upstream of the flue to allow for ash and other residue of the solid fuel mode.

It is yet another object of the invention to provide a double-fired heating boiler in which space within the boiler water compartment is efficiently utilized for the passage therethrough of ancillary heat exchange surfaces.

In order that the invention may be more fully comprehended, it will now be described by way of example and in relation to a preferred embodiment with reference to the accompanying drawings.

DESCRIPTION OF THE PREFERRED EMBODIMENTS

Figure 1:
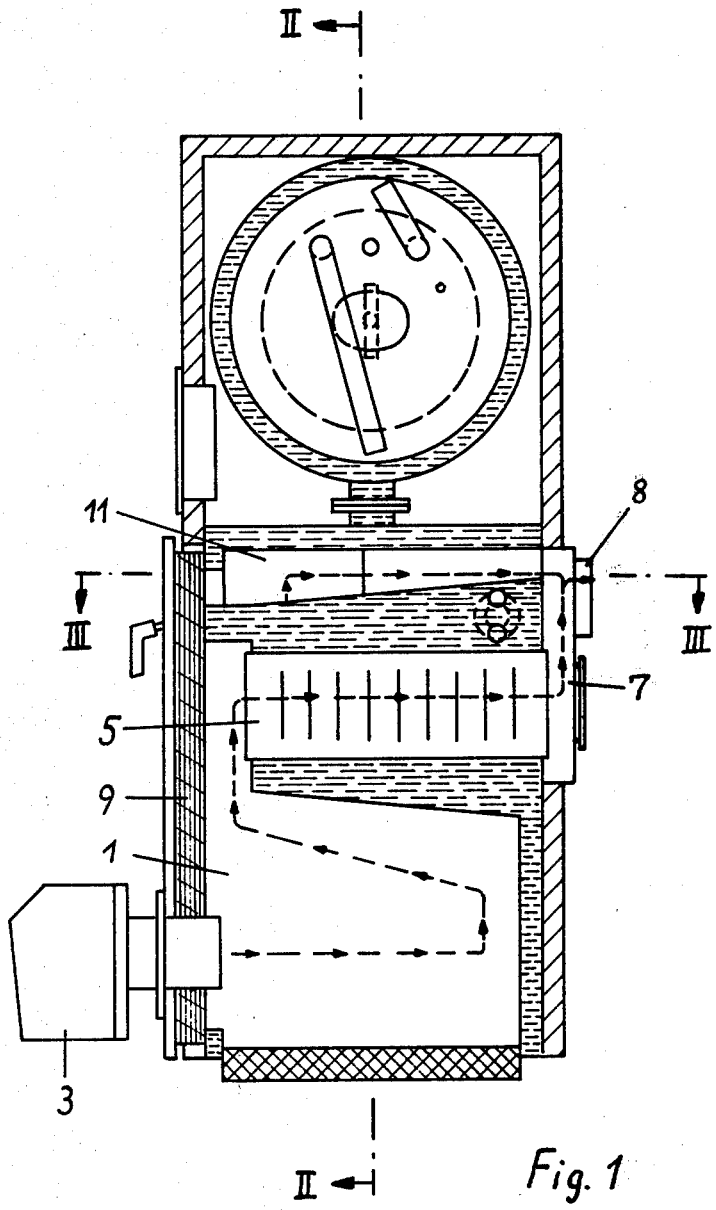
FIG. 1 is a side elevational view of the heating boiler partly in cross-section.

In the drawings, the heating boiler is provided with separate combustion chambers 1 and 2 for the burner firing of oil or gas, for example by means of a burner 3, and for solid fuel firing respectively. The combustion chambers are arranged side-by-side in a common boiler water compartment or chamber 4. Separate exhaust conduits 5 and 6 for combustion gases produced are connected to combustion chambers 1 and 2 and pass completely separately from one another through the boiler water chamber 4 and terminate in a common combustion gas collector 7 for the heating boiler. The conduit arrangement 5 for the oil or gas burner firing consists of a plurality of individually finned heat exchange conduits which extend in the boiler water chamber 4 above the combustion chamber 1. Such conduits 5 communicate at their forward end with the combustion chamber 1 within which the flame reverses in the rear, closed chamber end and the combustion gases flow back to the forward end of the combustion chamber. The rear ends of conduits 5 open into the combustion gas collector or manifold member 7 arranged at the rear end of chamber 1, which collector member is connected with an exhaust pipe 8 for connection therewith of a flue pipe. The combustion chamber 1 is closed by a large combustion chamber door 9 which, upon opening, provides access to both the combustion chamber 1 and conduits 5 for the purpose of cleaning. The conduit arrangement 6 for the solid fuel firing is not divided into individual parallel component conduits, but consists of a single passage extending substantially from the boiler front to the rear of the boiler. It thus has an especially large internally unobstructed flow passage which makes possible long firing times with solid fuel without the need for maintenance and boiler cleaning. Conduit arrangement 6 includes a vertical section 10 which is positioned between the two combustion chambers 1 and 2 in the boiler water chamber 4, and a horizontal or laterally extending section 11 connected to vertical section 10 and extending laterally into the area of the boiler water chamber above the burner firing combustion chamber 1. Section 11 terminates adjacent the rear of the heating boiler in collector 7 so that the flow paths for the burner firing and for the solid fuel firing combustion gases terminate at substantially the same point at the rear of the boiler. This makes it possible to employ a relatively small, spacesaving collector member. The vertical section 10 is open at the front of the boiler and is closed by a removable cover 12 so that this vertical section 10 can conveniently be cleaned from the front of the boiler. The horizontal section 11 is open in the region of the combustion chamber door 9 at the front of the boiler and may be sealingly closed off by combustion chamber door 9. Thus, when the combustion chamber door 9 is opened the horizontal section 11 of the exhaust conduit arrangement 6 is exposed at the same time and can also be cleaned conveniently from the front of the boiler. In order that long-flame fuels with under-burning can be burned, the conduit arrangement 6 communicates with the lower end of the solid fuel combustion chamber 2, its inlet 13 from the combustion chamber 2 being closely adjacent and above a grate 14. An oblique grate 15 is positioned between grate 14 and inlet 13 to afford direct air entry into vertical section 10 of conduit arrangement 6. Thus, very good combustion results are achieved with an extremely low carbon monoxide content in the exhaust gases. With the under-burning on the longitudinal side, that is to say with the opening of the conduit arrangement 6 laterally into one longitudinal side of the combustion chamber 2, a very good part-load regulability of the solid fuel firing system is achieved. At the upper end of the solid fuel combustion chamber 2 there is provided a narrow by-pass slot opening 16 which can extend throughout the entire depth of this combustion chamber 2 thereby making possible a direct withdrawal of incompletely burned gases from the upper region of the combustion chamber 2 into the conduit system 6 which gases may collect in the upper region of the combustion chamber 2, for example after the opening of the upper charging door 21.

Figure 2:
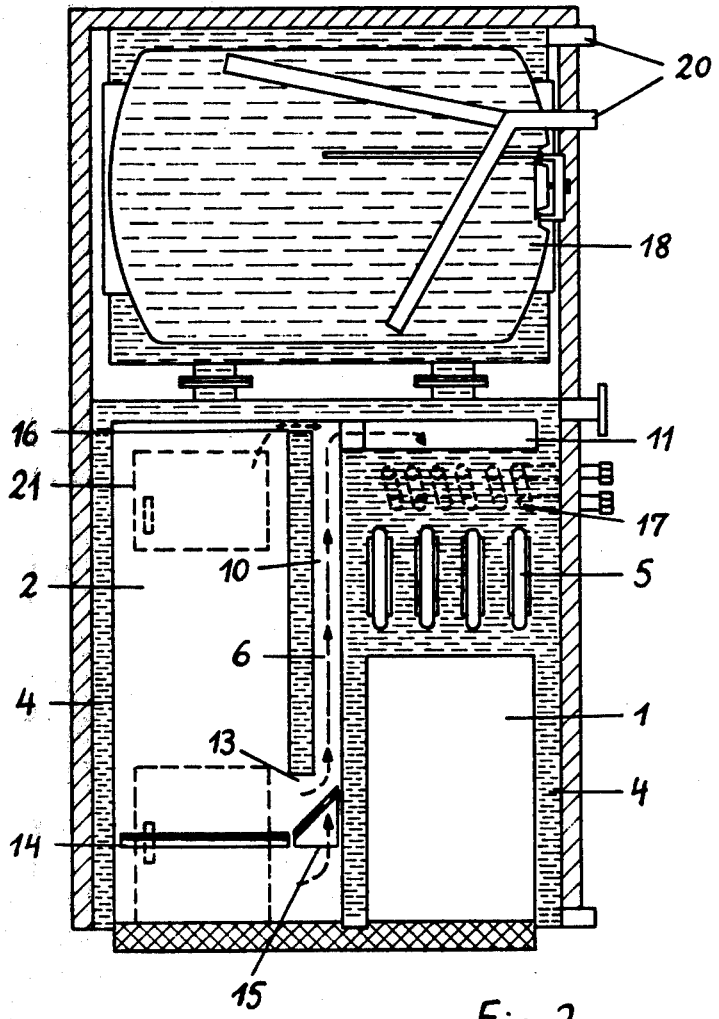
FIG. 2 is a vertical cross-sectional view of the heating boiler of FIG. 1 taken along line II—II thereof.
Figure 3:
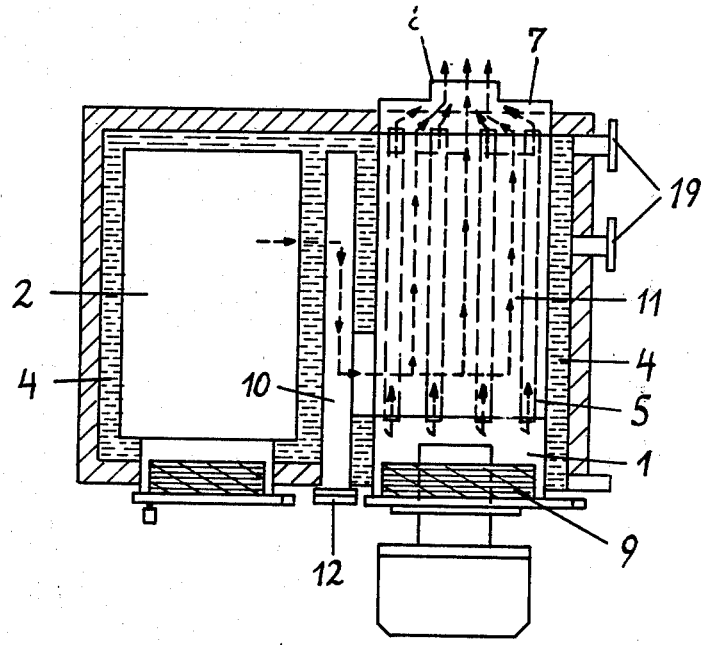
FIG. 3 is a vertical cross-sectional view of the heating boiler of FIG. 1 taken along line III—III thereof.

Due to the arrangement of the two combustion chambers 1 and 2 side-by-side in the boiler water chamber 4, the space above the burner firing combustion chamber 1 within chamber 4 offers sufficient space for insertion of, for example a service water throughput heater pipe coil or an electric heating member 17 for off-peak current heating. Such coil or member may be arranged between the conduits 5 and horizontal section 11 of the conduit system 6. The heating boiler can also be equipped with a service water tank 18 which is heated by the boiler water in the case of oil or gas burner firing operation or for the production of hot service water in the case of the burning, for example, of waste wood in summer. In an advantageous manner the heating boiler is formed so that the boiler water connections 19 and the tank connections 20 lie on the same side of the heating boiler, as can be seen most clearly from FIGS. 2 and 3. A predetermined spacing from the wall is necessary on account of the possibility of pivoting out the burner door. In this way all heating installation parts, as for example, the circulating pump and mixer valve and the like, and all sanitary installation parts, as for example, conduits and valves for hot water, cold water and for circulation, are easily and accessibly accommodated and arranged for maintenance on the side of the heating boiler. The wall distance at the rear of the heating boiler can, therefore, be kept very small.

The heating boiler described has the further advantage that the water space above the burner firing combustion chamber 1, which has the higher performance capacity of the two combustion chambers and therefore requires a lower height than the solid fuel combustion chamber 2, may be utilized for the water-cooled arrangement of the horizontal conduits 5 of the oil and gas-burner firing system as well as for the horizontal section 11 of the solid fuel firing system. In this manner sufficient space is available for conduits 5 so that such conduits 5 can be given the most favorable configuration and construction for burner firing with a large heat exchange area. Furthermore, the entire height of the boiler water chamber 4 is available for the height of a large volume solid fuel combustion chamber.

What is claimed is:

1. A double-fired heating boiler adapted to be fired selectively by oil, gas or a solid fuel, comprising:

a boiler water chamber;

first and second combustion chambers horizontally spaced from one another within said boiler water chamber and adapted respectively to be oil or gas-fired and solid fuel-fired, said first combustion chamber having a height less than the height of said second combustion chamber, said boiler water chamber having a portion vertically disposed in superimposed relationship over said first combustion chamber and horizontally disposed laterally of the upper portion of said second combustion chamber;

a, collector member for the combustion gases of said first and second combustion chambers;

a first conduit passage having heat exchange surfaces connected to said first combustion chamber and extending through said boiler water chamber and terminating in said common combustion gas collector member;

a second conduit passage having heat exchange surfaces connected to said second combustion chamber and extending through said boiler water chamber and terminating in said common combustion gas collector member;

said first and second conduit passages extending completely separately from said first and second combustion chambers respectively and through said boiler water chamber to said common combustion gas collector member;

said first conduit passage having a horizontal section extending within said boiler water chamber portion, said horizontal section being superimposed over said first combustion chamber and communicating at the front end of said heating boiler with said first combustion chamber and at the rear end of said heating boiler with said collector member, said second conduit passage comprising a horizontally extending section within said boiler water chamber portion superimposed over said first combustion chamber and communicating with said second combustion chamber and lying in superimposed spaced relationship to the horizontal conduit section of said first conduit passage.

2. A double-fired heating boiler adapted to be fired selectively by oil, gas or a solid fuel, comprising:

a boiler water chamber;

first and second combustion chambers positioned side-by-side within said boiler water chamber and adapted respectively to be oil or gas-fired and solid fuel-fired;

a common collector member for the combustion gases of said first and second combustion chambers;

a first conduit passage having heat exchange surfaces connected to said first combustion chamber and extending through said boiler water chamber and terminating in said common combustion gas collector member;

a second conduit passage having heat exchange surfaces connected to said second combustion chamber and extending through said boiler water chamber and terminating in said common combustion gas collector member;

said first and second conduit passages extending completely separately from said first and second combustion chamber respectively and through said boiler water chamber to said common combustion gas collector member;

said first conduit passage extending horizontally within said boiler water chamber and situated above said first combustion chamber and communicating at the front end of said heating boiler with said first combustion chamber and at the rear end of said heating boiler with said collector member, said second conduit passage including a horizontally extending section communicating with said second combustion chamber and lying in superimposed spaced relation to the horizontal conduit passage for said first combustion chamber;

said second conduit passage for said second combustion chamber including a vertically extending section connected to said second combustion chamber and to said horizontally extending section and wherein said vertically extending section is positioned between said first and second combustion chambers and is in communication with the lower region of said second combustion chamber.

3. A double-fired heating boiler according to claim 2, wherein said vertically extending section of the conduit passage for said second combustion chamber is accessible from outside the front end of said heating boiler, a cover being provided for sealing said vertically extending section, the heating boiler having a door member at the front end thereof for sealingly and accessibly closing said first combustion chamber, said horizontally extending conduit passage for said first combustion chamber, and said horizontally extending section of the conduit passage for said second combustion chamber.

4. A double-fired heating boiler adapted to be fired selectively by oil, gas or a solid fuel, comprising:

a boiler water chamber;

first and second combustion chambers positioned side-by-side within said boiler water chamber and adapted respectively to be oil or gas-fired and solid fuel-fired;

a common collector member for the combustion gases of said first and second combustion chambers;

a first conduit passage having heat exchange surfaces connected to said first combustion chamber and extending through said boiler water chamber and terminating in said common combustion gas collector member;

a second conduit passage having heat exchange surfaces connected to said second combustion chamber and extending through said boiler water chamber and terminating in said common combustion gas collector member;

said first and second conduit passages extending completely separately from said first and second combustion chambers respectively and through said boiler water chamber to said common combustion gas collector member;

said first conduit passage extending horizontally within said boiler water chamber and situated above said first combustion chamber and communicating at the front end of said heating boiler with said first combustion chamber and at the rear end of said heating boiler with said collector member;

said second conduit passage comprising a horizontally extending section communicating with said second combustion chamber and lying in superimposed spaced relating to the horizontal conduit passage for said first combustion chamber, said second conduit passage further comprising a vertically extending section having its lower end connected to said second combustion chamber and its upper end joined to said horizontally extending section and wherein said vertically extending section is positioned in the boiler water chamber forming an ancillary heating area between said first and second combustion chambers and is in communication with the lower region of said second combustion chamber.

* * * * *